US010615528B2

(12) United States Patent
Suzuki et al.

(10) Patent No.: US 10,615,528 B2
(45) Date of Patent: Apr. 7, 2020

(54) ELECTRICAL CONNECTOR

(71) Applicant: IRISO ELECTRONICS CO., LTD., Kanagawa (JP)

(72) Inventors: Hitoshi Suzuki, Kanagawa (JP); Yoshihito Ohkuma, Kanagawa (JP); Hiroaki Yukutake, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 16/016,877

(22) Filed: Jun. 25, 2018

(65) Prior Publication Data

US 2019/0020134 A1 Jan. 17, 2019

(30) Foreign Application Priority Data

Jul. 11, 2017 (JP) ..... 2017-135784

(51) Int. Cl.
*H01R 12/73* (2011.01)
*H01R 12/70* (2011.01)
*H01R 12/91* (2011.01)

(52) U.S. Cl.
CPC ..... *H01R 12/73* (2013.01); *H01R 12/7005* (2013.01); *H01R 12/91* (2013.01)

(58) Field of Classification Search
CPC ..... H01R 13/6315; H01R 13/28
(Continued)

(56) References Cited

U.S. PATENT DOCUMENTS 5,980,290 A * 11/1999 Meynier ..... H01R 13/6315 439/246
9,033,743 B2 * 5/2015 Kobayashi ..... H01R 13/11 439/637

(Continued)

FOREIGN PATENT DOCUMENTS

JP 4-54165 U 5/1992
JP 3905518 B2 1/2007

(Continued)

OTHER PUBLICATIONS

Agenda (Year: 2019).*
Office Action for Japanese Patent App. No. 2017-135784 (dated Jun. 29, 2018).

*Primary Examiner* — Tulsidas C Patel
*Assistant Examiner* — Marcus E Harcum
(74) *Attorney, Agent, or Firm* — Cermak Nakajima & McGowan LLP; Tomoko Nakajima

(57) ABSTRACT

A connector to which a connection target object is fitted and connected by inserting the connection target object into a fitting chamber is configured to allow the fitting operation to be readily performed even in a case where the connector is small.

An insertion guiding surface is provided round an insertion port through which the connection target object is inserted. The insertion guiding surface has an inner guiding surface that extends from the edge of the insertion port toward the fitting chamber, an intermediate guiding surface provided in a region outside the inner guiding surface, and an outer guiding surface provided in a region outside the intermediate guiding surface. The inner guiding surface differs from the intermediate guiding surface in terms of shape, and the intermediate guiding surface differs from the outer guiding surface in terms of shape.

8 Claims, 9 Drawing Sheets

(58) Field of Classification Search
USPC ..... 439/247, 636, 637
See application file for complete search history.

(56) References Cited

U.S. PATENT DOCUMENTS

| | | | | |
|---|---|---|---|---|
| 9,246,283 | B2 * | 1/2016 | Sato | H01R 24/60 |
| 2008/0214035 | A1 * | 9/2008 | Uesaka | H01R 12/57 439/247 |
| 2011/0165797 | A1 | 7/2011 | Takeuchi et al. | |
| 2015/0064975 | A1 * | 3/2015 | Funayama | H01R 12/91 439/626 |
| 2016/0294111 | A1 * | 10/2016 | Kobayashi | H01R 13/187 |
| 2017/0338592 | A1 * | 11/2017 | Doi | H01R 13/6315 |
| 2018/0198234 | A1 * | 7/2018 | Takane | H01R 13/6315 |
| 2018/0287301 | A1 * | 10/2018 | Tanaka | H01R 13/6315 |

FOREIGN PATENT DOCUMENTS

| | | | |
|---|---|---|---|
| JP | 2010-15739 | A | 1/2010 |
| JP | 2016-129148 | A | 7/2016 |

* cited by examiner

ELECTRICAL CONNECTOR

BACKGROUND OF THE INVENTION

Field of the Invention

The present invention relates to a connector into which a connection target object is so inserted that the connection target object is fitted and connected to the connector.

Description of the Related Art

As the size of an electric apparatus further decreases, a connector is also required to be reduced in size. However, the smaller a connector is, the more difficult the fitting operation is, because the opening of an insertion port through which a connection target object is inserted into a fitting chamber of the housing of the connector also has a smaller area. For example, the smaller a connector for substrate-to-substrate connection is, such as that shown in FIG. 1 of Japanese Patent Laid-Open No. 2016-129148, the more difficult the fitting operation is.

That is, the problem described above will be described with reference to a socket connector and a plug connector that form a connector for substrate-to-substrate connection. The fitting operation of causing the plug connector to face the socket connector and inserting the plug connector into the insertion port of the socket connector needs to be performed in a state in which the two connectors are not visually recognized because the pair of substrates hide the socket connector and the plug connector. The reason for this is that the connectors are located between the substrates and therefore not visually recognized. Therefore, conventionally, in the case of the connector for substrate-to-substrate connection, it is difficult to align the socket connector and the plug connector with each other for fitting connection, resulting in inefficient operation, and further causing a possibility of breakage of the connectors if the fitting operation is performed in a haste forcible manner.

The difficulty in the fitting operation is not specific to a connector for substrate-to-substrate connection but common to a connector that requires fitting operation of inserting a connection target object into a fitting chamber via an insertion port of the housing of the connector. Because the smaller the area of the opening of the insertion port due to the reduction in size of the connector is, the more difficult the alignment of the connection target object with the insertion port is, even though fitting operation is performed in a state in which the connector and the connection target object are visually recognizable.

The present invention has been made based on the related art described above. An object of the present invention is to allow fitting operation performed on a small connector to be readily performed.

SUMMARY OF THE INVENTION

To achieve the object described above, the present invention has the following features:

That is, the present invention relates to a connector including a housing having an insertion port into which a connection target object is inserted in a direction toward a surface of a substrate as an insertion direction and a fitting chamber into which the connection target object is inserted via the insertion port, and terminals that are electrically connected to the connection target object in the fitting chamber. The housing has an insertion guiding surface that guides the insertion of the connection target object via the insertion port, and the insertion guiding surface has an inner guiding surface that extends from an edge of the insertion port toward an interior of the fitting chamber, an intermediate guiding surface provided outside the inner guiding surface, and an outer guiding surface provided outside the intermediate guiding surface with the inner guiding surface being different from the intermediate guiding surface in terms of shape and the intermediate guiding surface being different from the outer guiding surface in terms of shape.

The connector according to the present invention has the insertion guiding surface that guides the insertion of the connection target object via the insertion port. Therefore, even in a case where the position where the connection target object is inserted into the insertion port is shifted, the insertion guiding surface can eliminate the positional shift and guide the connection target object to the insertion port, whereby the connection target object can be correctly inserted into the fitting chamber via the insertion port.

Specifically, the insertion guiding surface can be configured to have the inner guiding surface that extends from the edge of the insertion port toward the interior of the fitting chamber, the intermediate guiding surface provided outside the inner guiding surface, and the outer guiding surface provided outside the intermediate guiding surface. The insertion guiding surface can further be so configured that the inner guiding surface differs from the intermediate guiding surface in terms of shape and the intermediate guiding surface differs from the outer guiding surface in terms of shape. In the configuration described above, in which two continuous surfaces have different shapes, when the connection target object is placed on the insertion guiding surface and moved from one of the surfaces that differ from each other in terms of shape to the other surface, an operator can guide the connection target object to the insertion port while recognizing a change in the attitude of the connection target object in the form of hand sensation. Further, since the insertion guiding surface has not only the inner guiding surface provided along the edge of the insertion port but the intermediate guiding surface located outside the inner guiding surface and the outer guiding surface located outside the intermediate guiding surface, the insertion of the connection target object can be guided over a wide range around the insertion port of the housing. The connector according to the present invention therefore allows operation of fitting the connection target object to be readily performed even though the size of the entire connector is reduced.

The inner guiding surface differs from the intermediate guiding surface in terms of shape and the intermediate guiding surface differs from the outer guiding surface in terms of shape. The phrase "differ in terms of shape" used herein includes a case where the surfaces differ from one another at least in terms of the "outer shape," a case where the surfaces differ from one another in terms of "angles" thereof with respect to a reference line perpendicular to the insertion direction of the connection target object, and a case where the surfaces differ from one another in terms of "angles" thereof with respect to a reference line parallel to a mounting surface of the substrate. Therefore, the inner guiding surface, the intermediate guiding surface, and the outer guiding surface can be inclining surfaces that incline with respect to any of the reference lines described above by different angles, a horizontal surface, or any other surface or can be configured as surfaces having different outer shapes, such as a flat surface, a curved surface (convex curved surface, concave curved surface), a stepped surface, and other surfaces.

In the present invention described above, the inner guiding surface, the intermediate guiding surface, and the outer guiding surface can be configured to differ from one another in terms of the shape thereof.

According to the present invention, in which the inner guiding surface, the intermediate guiding surface, and the outer guiding surface differ from one another in terms of the shape thereof, the attitudes of the connection target object that comes into contact with the surfaces can differ from one another in accordance with the differences in the shape among the guiding surfaces. The operator can therefore guide the connection target object to the insertion port while recognizing a change in the attitude of the connection target object that occurs when the connection target object is moved from the outer guiding surface to the insertion port.

In the present invention described above, the difference in the shape between the inner guiding surface and the intermediate guiding surface and the difference in the shape between the intermediate guiding surface and the outer guiding surface can each be a difference in an angle with respect to a reference line perpendicular to the insertion direction.

According to the present invention, which the difference in the shape between the inner guiding surface and the intermediate guiding surface is the angle with respect to the reference line and the difference in the shape between the intermediate guiding surface and the outer guiding surface is the angle with respect to the reference line, the operator can readily recognize a change in the attitude of the connection target object by the difference of a dihedral angle.

In the present invention described above, the angle of the intermediate guiding surface can be configured to be smaller than the angle of the inner guiding surface and the angle of the outer guiding surface.

For example, in a case where the angle of the intermediate guiding surface is greater than the angle of the outer guiding surface, and when the connection target object is moved from the outer guiding surface to the intermediate guiding surface, the attitude of the connection target object greatly inclines. In this case, the attitude cannot be gradually corrected during the approach to the insertion port, and it is therefore difficult to smoothly guide the connection target object to the insertion port. On the other hand, in a case where the angle of the intermediate guiding surface is greater than the angle of the inner guiding surface, a recess in which an internal angle is an obtuse angle is provided at the boundary between the intermediate guiding surface and the inner guiding surface. In this case, the connection target object is caught by the recess during the movement of the connection target object, and it is therefore difficult to smoothly guide the connection target object to the insertion port. In contrast, according to the present invention, the connection target object can be readily guided to an inner position near the insertion port rather than the outer guiding surface because the angle of the outer guiding surface is greater than the angle of the intermediate guiding surface. Further, since the angle of the inner guiding surface is greater than the angle of the intermediate guiding surface, the connection target object can be smoothly guided from the intermediate guiding surface to the inner guiding surface, which is directly connected to the insertion port. Therefore, the connector according to the present invention allows the connection target object to be smoothly guided from the outer guiding surface to the insertion port.

In the present invention described above, the intermediate guiding surface can be configured to be a flat surface parallel to the substrate.

According to the present invention, since the intermediate guiding surface is a flat surface parallel to the substrate, the distance over which the connection target object is movable in the horizontal direction, which is parallel to the substrate, can be increased as compared with a case where the intermediate guiding surface is an inclining surface that inclines with respect to the reference line parallel to the substrate, whereby the acceptable range of the positional shift (guiding region) of the connection target object with respect to the insertion port on the intermediate guiding surface can be widened. Further, since the intermediate guiding surface is a flat surface parallel to the substrate surface, the connection target object can be so corrected so as to have a non-inclining attitude to be smoothly guided in the correct attitude to the insertion port. Further, for example, in the case where the intermediate guiding surface is an inclining surface that inclines with respect to the substrate, the intermediate guiding surface has a height, resulting in an increase in the size of the housing in the height direction. In contrast, in the present invention, which the intermediate guiding surface is parallel to the substrate and the distance from the substrate to the intermediate guiding surface is fixed, an increase in the size of the housing in the height direction can be suppressed. The term "flat surface parallel to the substrate" in the present invention can be taken as a "flat surface along the reference line perpendicular to the insertion direction" in a case where the substrate surface is parallel to the reference line perpendicular to the insertion direction of the connection target object.

In the present invention described above, the outer guiding surface and the inner guiding surface can be formed as inclining surfaces that differ from each other in terms of the angle, and the angle of the outer guiding surface can be configured to be smaller than the angle of the inner guiding surface.

For example, in a case where the outer guiding surface is an inclining surface and the distance over which the connection target object is moved in the horizontal direction from the outer edge to the inner edge (edge facing boundary with intermediate guiding surface) of the outer guiding surface is so set as to be constant, the greater the angle of the outer guiding surface is, the higher the outer edge of the outer guiding surface relative to the inner edge thereof is, resulting in an increase in the size of the housing in the height direction. In contrast, according to the present invention, the angle of the outer guiding surface is smaller than the angle of the inner guiding surface, an increase in the size of the housing in the height direction due to the outer guiding surface can be avoided while a sufficient distance over which the connection target object is moved from the outer edge to the inner edge of the outer guiding surface is ensured. Further, according to the present invention, since the angle of the outer guiding surface is smaller than the angle of the inner guiding surface, the connection target object is roughly guided toward the insertion port side by causing the connection target object to move on the outer guiding surface having a shallow inclination, and then it is possible to insert the connection target object so as to swiftly incorporate it from the insertion port into the fitting chamber on the inner guiding surface having an inclination angle larger than that of the outer guiding surface.

In the present invention described above, the housing can have a circumferential wall and a protruding section that protrudes outward from the circumferential wall, and the outer guiding surface can be provided on an upper surface of the protruding section.

For example, when the outer guiding surface is formed on the upper end surface of the circumferential wall, the outer guiding surface needs to be formed in a state in which the circumferential wall has an increased thickness along the direction perpendicular to the insertion direction of the connection target object, resulting in an increase in the size of the housing in the direction perpendicular to the insertion direction. In contrast, in the present invention, since the outer guiding surface is provided on the upper surface of the protruding section, which protrudes from the circumferential wall, the outer guiding surface can be extended in the direction away from the insertion port with no increase in the thickness of the circumferential wall, whereby the acceptable range of the positional shift of the connection target object can be widened.

In the present invention described above, the intermediate guiding surface can be provided on an upper surface of the circumferential wall.

In general, the upper surface of the circumferential wall that forms the housing of a connector has no particular function. In contrast, according to the present invention, since the upper surface of the circumferential wall can be effectively used as the intermediate guiding surface, the intermediate guiding surface can be provided without an increase in the size of the housing, such as an increase in the thickness of the circumferential wall or provision of a protruding section that protrudes from the circumferential wall.

In the present invention described above, the connector can further include a fixed housing fixed to the substrate, the housing can be a movable housing which is movable relative to the fixed housing, and the terminals can each have a fixing section fixed to the fixed housing, a fixing section fixed to the movable housing, and a spring section that supports the movable housing in such a way that the movable housing is movable relative to the fixed housing.

In a connector of related art (floating connector) which includes a fixed housing and a movable housing and in which a spring section of each terminal supports the movable housing movably relative to the fixed housing, in a case where the connection target object is positionally shifted with respect to the insertion port of the movable housing, the positional shift of the connection target object cannot be absorbed by moving the movable housing with the aid of elastic deformation of the spring section of each terminal unless the connection target object is inserted into the insertion port. That is, before the connection target object enters the insertion port, the connection target object needs to be guided to the insertion port with no aid of the movement (displacement) of the movable housing pressed by the spring section. Therefore, a guiding inclining surface that leads to the fitting chamber is provided along the edge of the insertion port of the movable housing, but the connection target object cannot be guided to the guiding inclining surface. Accordingly, the smaller the connector is, the more difficult the alignment of the connection target object with the insertion port is. The fitting operation is more inefficient, and the spring section of each terminal could be plastically deformed if the fitting operation is forcibly performed. In contrast, according to the present invention, since the insertion guiding surface can readily guide the connection target object to the insertion port of the movable housing with no forcible operation, the connection target object can be readily aligned with the insertion port even though the connector has a small size, whereby the fitting operation can be efficiently performed.

In the present invention described above, the spring sections can be located between the movable housing and the fixed housing, and the protruding section can be so shaped as to cover an upper side of the spring sections.

According to the present invention, the protruding section is so shaped as to cover the upper side of the spring sections located between the movable housing and the fixed housing, it prevents the spring sections from contacting an external foreign matter from outside, whereby the spring sections can be protected.

In the present invention described above, the movable housing can have groove-shaped terminal accommodation sections that communicate with the fitting chamber, the terminal accommodation sections can each have a bottom wall that forms the groove-shaped bottom surface, the bottom surface of the bottom wall can be so shaped as to incline in such a way that a groove depth of the terminal accommodation section from the fitting chamber increases on a side facing the insertion port as compared with a deep side of the fitting chamber, a retraction space that prevents from abutting against a contact section of the terminal can be provided between the bottom wall and the fitting chamber.

For example, in a case where the bottom wall of each of the groove-shaped terminal accommodation sections is formed along the vertical direction, the entire bottom surface of the bottom wall needs to be so formed deeply as to be separate from the fitting chamber as much as possible so that the terminal contact section displaced inward into the terminal accommodation section does not come into contact with the bottom wall under press contact from the connection target, undesirably resulting in an increase in the size of the movable housing in the direction perpendicular to the insertion direction of the connection target object. In contrast, according to the present invention, since the bottom surface of the bottom wall of each of the terminal accommodation sections inclines so that the retraction space is formed between the bottom wall and the fitting chamber, the contact section of the terminal does not come into contact with the bottom wall without an increase in the size of the movable housing, unlike the case described above.

In the present invention described above, the outer surface of the bottom wall can have an outer inclining surface that inclines outward from the substrate side, and the spring section can have an inclining piece section that extends along the outer including surface.

As the spring section provided on part of a terminal of a floating connector, for example, there is a known inverted-U-letter-shaped spring section having a pair of longitudinal pieces that extend in parallel to each other along the vertical direction and an arcuate bent section that links the ends of the longitudinal pieces to each other. In a case where the spring section has a short spring length so that the spring is stiff, it is difficult to flexibly support the movable housing. If the length of the pair of longitudinal pieces extends in the longitudinal direction to increase the spring length, it causes an increase in the size of the connector particularly in the height direction. In contrast, according to the present invention, since the spring section has the inclining piece section, which obliquely extends along the outer inclining surface of the bottom wall of the movable housing, the spring length can be increased without an extension of the spring section in the height direction, and the movable housing can also be flexibly supported.

In the present invention described above, the connector can further include a fixture that fixes the fixed housing to the substrate, and the fixture can be configured to include an attachment section of a protective cap that covers at least the insertion port.

For example, if the fixed housing itself provides for the attachment section of the protective cap, the size of the fixed housing increases, and the attachment section of the fixed housing could be damaged when the protective cap is attached and detached to and from the fixed housing. In contrast, according to the present invention, since the fixed housing does not need to have the attachment section and the fixture is a metal solid element, the protective cap can be reliably attached to the fixed housing, and the fixture is not broken even though the protective cap is attached and detached to and from the fixed housing.

In the present invention described above, the movable housing can include a displacement restricting protrusion that protrudes outward from the outer circumferential surface of the movable housing, and the fixture can be configured to include an abutment section that abuts against the displacement restricting protrusion to stop the movement of the movable housing.

According to the present invention, since the fixture is provided with the abutment section that restricts the movement of the movable housing, the fixed housing does not need to be provided with such an abutment section, and the fixture can be effectively used to restrict the displacement of the movable housing.

In the present invention described above, the connector can be configured to further include the protective cap attached to the fixture.

According to the present invention, since the protective cap is provided, the protective cap can prevent foreign matter from entering and adhering to the fitting chamber or the terminal from being damaged during transportation, mounting, and other types of handling of the connector.

According to the present invention, the insertion guiding surface can eliminate a shift of the position where the connection target object is inserted, so that the operation of fitting connection target object can be readily performed, whereby the size of the connector can be reduced.

DETAILED DESCRIPTION OF THE PREFERRED EMBODIMENT

Figure 1:
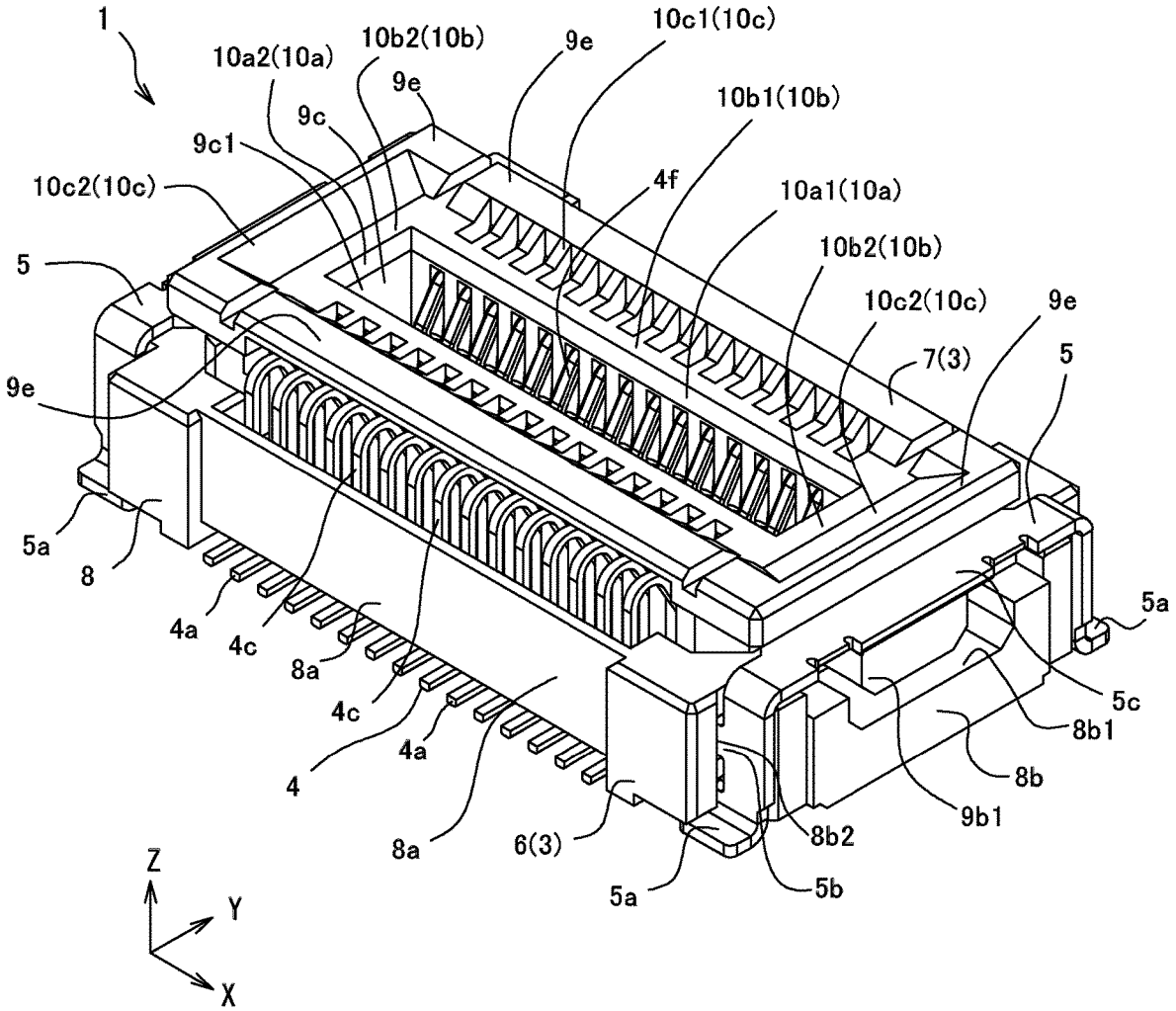
FIG. 1 is an exterior perspective view including the front surface, the right side surface, and the plan surface of a socket connector according to an embodiment.
Figure 2:
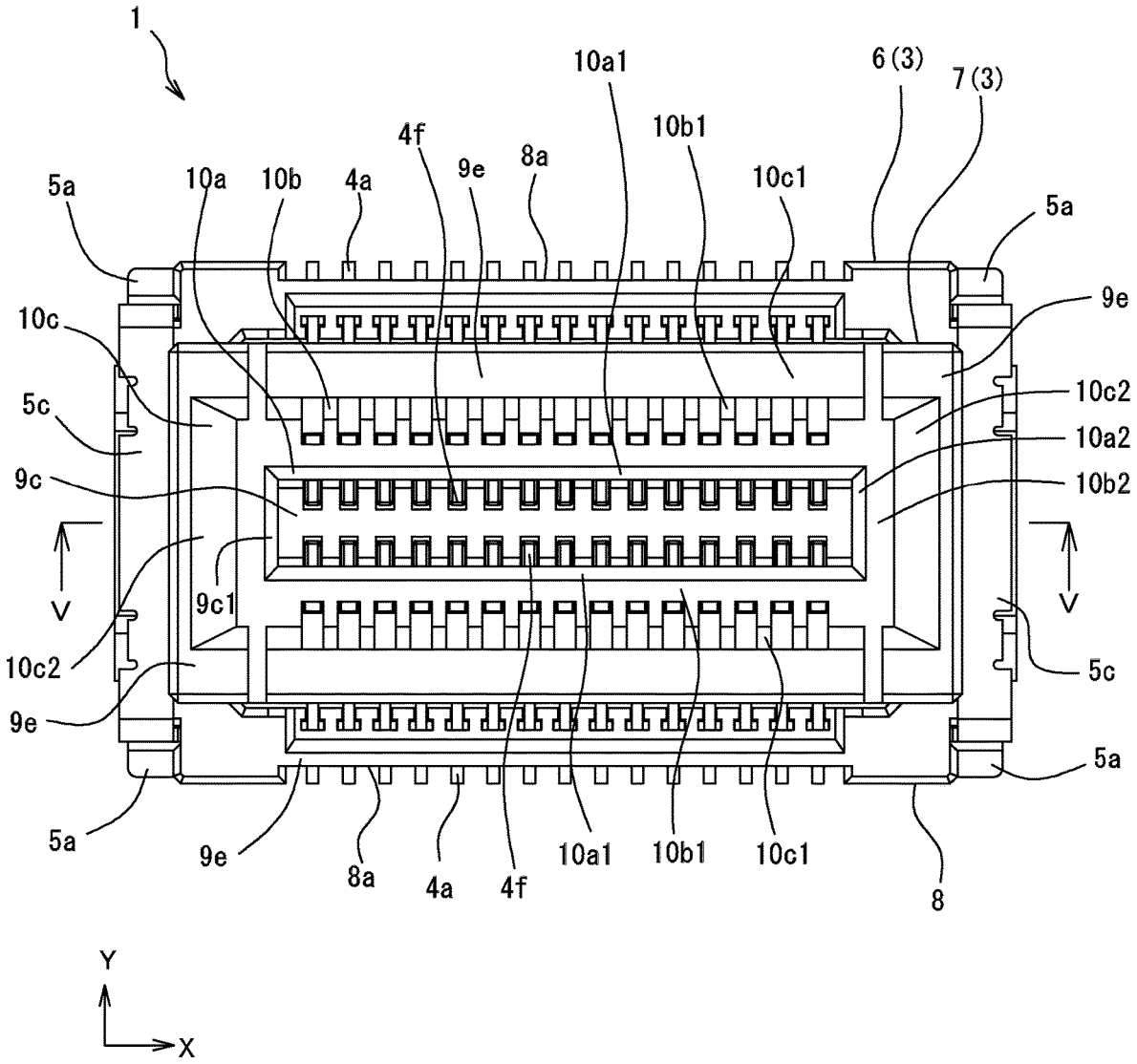
FIG. 2 shows the plan surface of the socket connector shown in FIG. 1.
Figure 3:
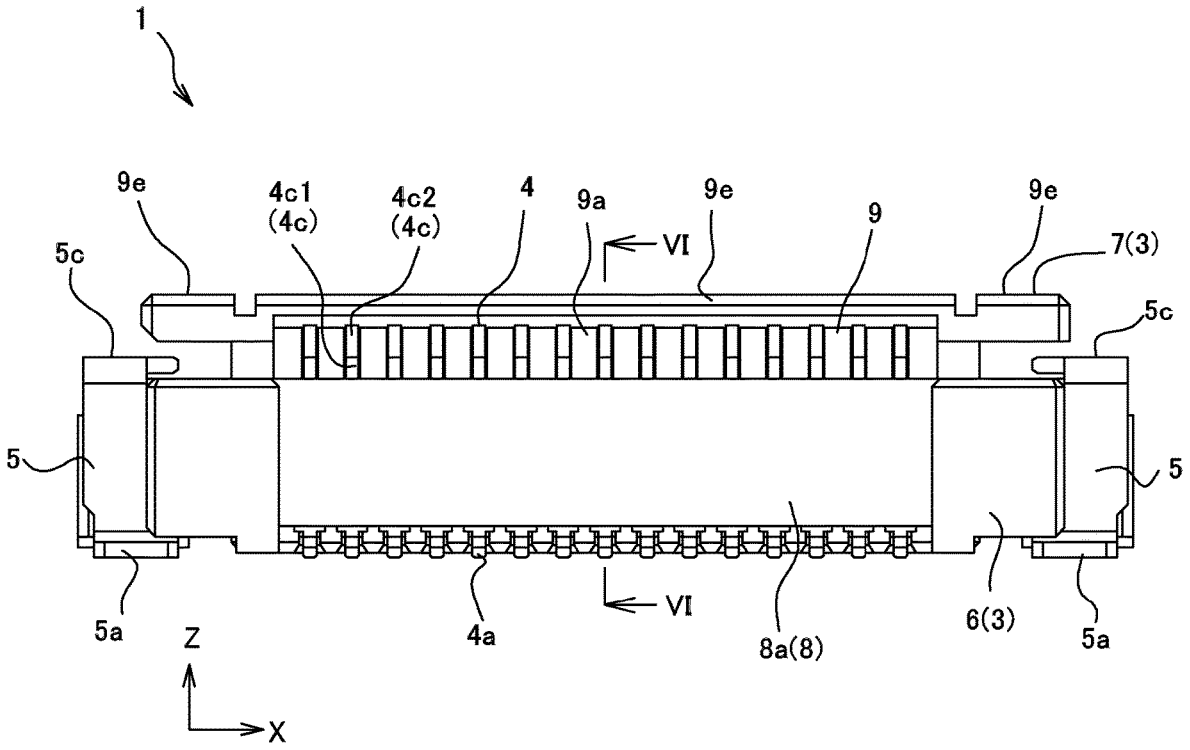
FIG. 3 shows the front surface of the socket connector shown in FIG. 1.

An embodiment of a connector according to the present invention will be described below with reference to the drawings. In the following embodiment, the connector according to the present invention is a socket connector 1, which is a connector for substrate-to-substrate connection and has the floating function, but it is not necessarily restricted to the above.

The terms "first" and "second" described in the present specification and claims are intended to distinguish components in different inventions and embodiments but are not intended to show a specific order or superiority/inferiority. Further, in the description of the present specification and claims, the width direction or the rightward/leftward direction of the socket connector 1 is a direction X, the depth direction or the frontward/rearward direction thereof is a direction Y, and the height direction or the upward/downward direction thereof is a direction Z for ease of description, but the definition of the directions are not intended to limit a method for mounting the socket connector 1 or a method for using the socket connector 1.

Socket Connector 1

A circuit of a first substrate P1 on which the socket connector 1 is mounted electrically connects to a circuit of a second substrate P2 on which a plug connector 2 is mounted, by the socket connector 1 being fitted and connected to the plug connector 2. (FIG. 8) That is, the socket connector 1 and the plug connector 2 each function as a connector for substrate-to-substrate connection.

The socket connector 1 includes a housing 3, a plurality of terminals 4, and fixtures 5. The housing 3 is formed of a fixed housing 6, which is mounted on the first substrate P1, and a movable housing 7, which is so supported by the terminals 4 as to be movable relative to the fixed housing 6. That is, the socket connector 1 is configured as a floating connector in which the movable housing 7 is movable relative to the fixed housing 6 in three-dimensional directions that is the combination of the directions X, Y, and Z.

Fixed Housing 6

The fixed housing 6 is formed of a frame-shaped circumferential wall 8. The circumferential wall 8 has a pair of first sidewalls 8*a*, which extend along the terminal arrangement direction (direction X) in which the plurality of terminals 4 are arranged in parallel to the socket connector 1, and a pair of second sidewalls 8*b*, which so extend as to link the opposing ends of the pair of first sidewalls 8*a* to each other. An accommodation chamber 8*c*, which accommodates the movable housing 7, is formed inside the thus configured circumferential wall 8 (FIGS. 5 and 6).

Figure 6:
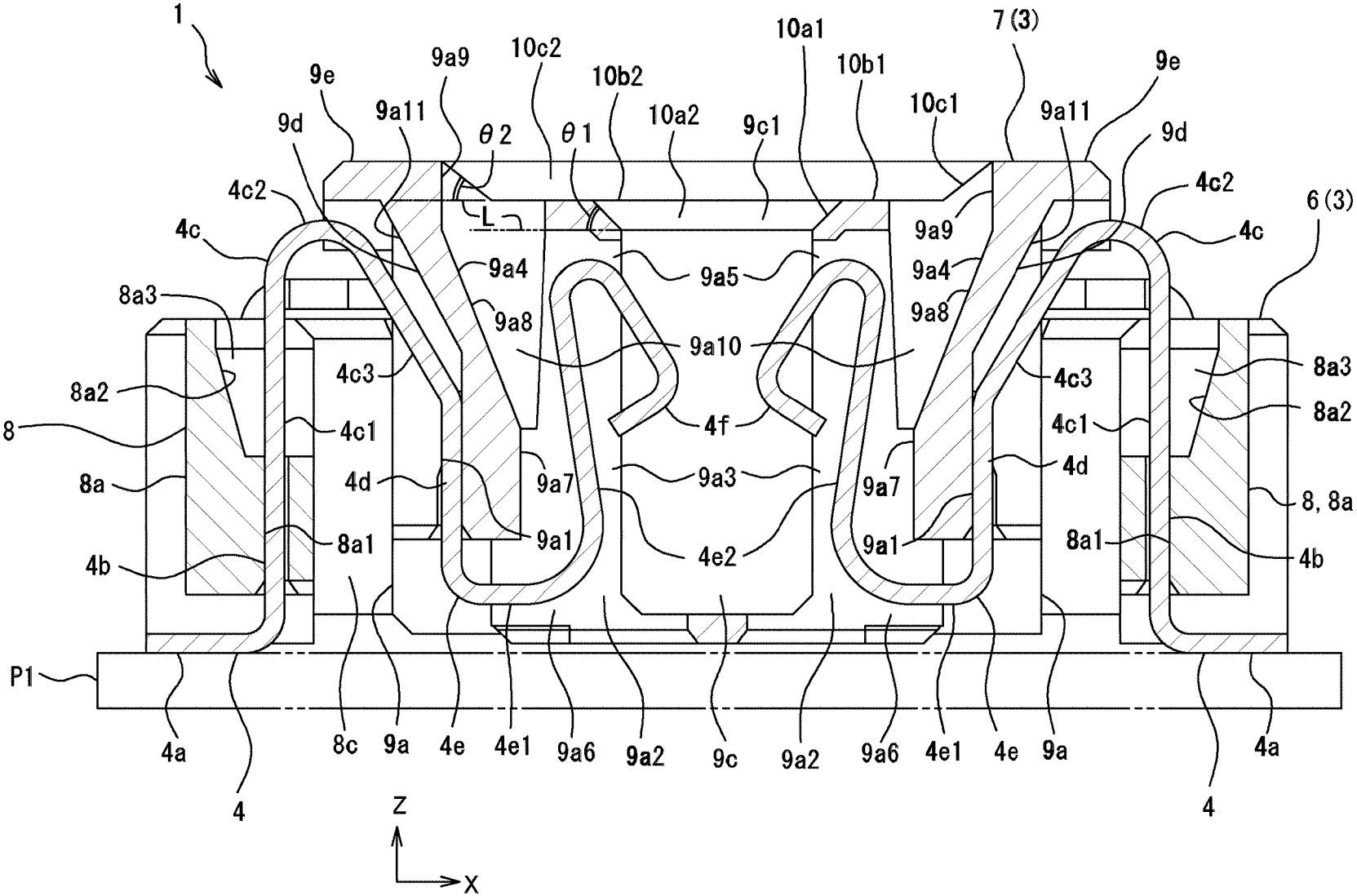
FIG. 6 is a cross-sectional view of the socket connector shown in FIG. 1 taken along the line VI-VI in FIG. 3.

A plurality of terminals fixing sections 8*a*1, which extend along the height direction Z of the fixed housing 6 and are arranged in parallel to each other along the terminal arrangement direction (direction X), are formed on each of the pair of first sidewalls 8*a* (FIGS. 1 and 6). One-side ends of the terminals 4 are press-fitted to the respective terminal fixing sections 8*a*1 and therefore fixed to the fixed housing 6. Part of the inner side surface of each of the first sidewalls 8*a* forms an inner inclining surface 8*a*2, which inclines from the upper ends of the terminal fixing sections 8*a*1 to the upper end of the sidewall 8*a*. By forming the inner inclining surfaces 8*a*2, a contact clearance section 8*a*3, which is formed of a gap space, is formed between the inner inclining surface 8*a*2 and spring sections 4*c* of the terminals 4, which will be described later. The contact clearance sections 8*a*3 prevent the first sidewalls 8*a* from restricting the amount of displacement of the spring sections 4*c*.

Figure 4:
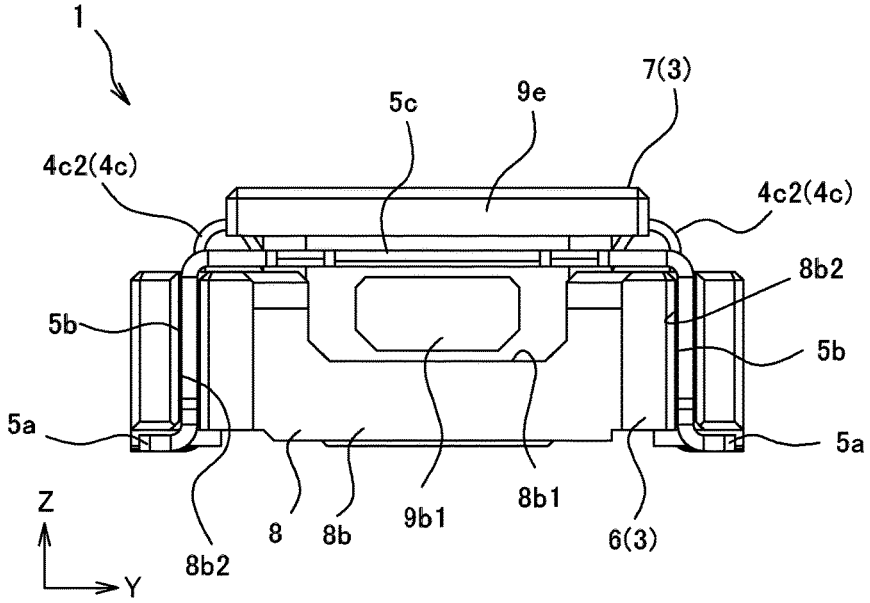
FIG. 4 shows the right side surface of the socket connector shown in FIG. 1.
Figure 5:
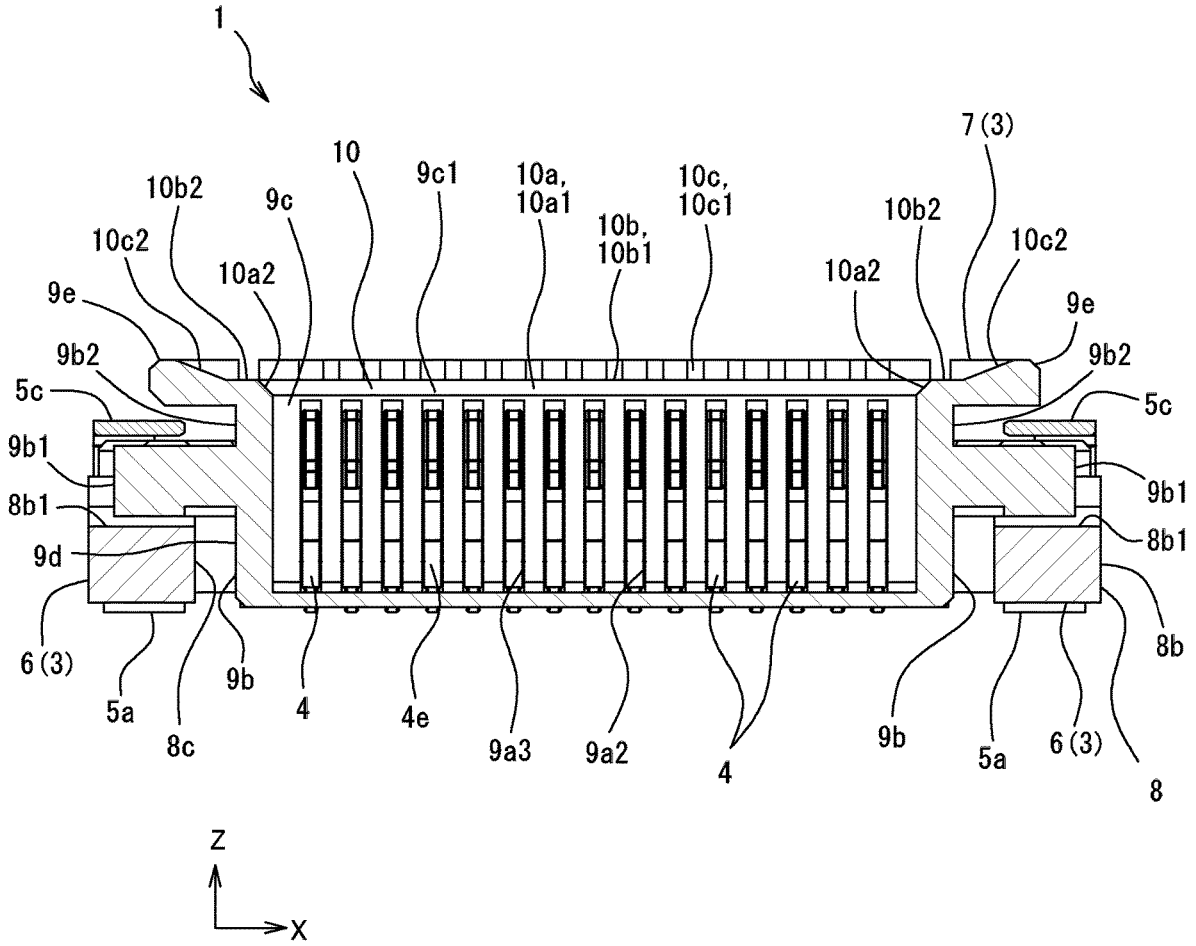
FIG. 5 is a cross-sectional view of the socket connector shown in FIG. 1 taken along the line V-V in FIG. 2.

The pair of second sidewalls 8*b* each have a recess 8*b*1, in which a displacement restricting protrusion 9*b*1 of the movable housing 7, which will be described later, is disposed (FIGS. 1, 4, and 5). Fixing sections 8*b*2, which fix the fixtures 5 in a press-fitting process, are formed on the second sidewalls 8*b*, and the fixtures 5 therefore securely hold the fixed housing 6 (FIG. 4).

Movable Housing 7

The movable housing 7 has a frame-shaped circumferential wall 9. The circumferential wall 9 has a pair of first sidewalls 9*a*, which extend along the terminal arrangement direction (direction X), in which the plurality of terminals 4 are arranged, and a pair of second sidewalls 9*b*, which so extend as to link the opposing ends of the pair of first sidewalls 9*a* (FIGS. 5 and 6). A fitting chamber 9*c*, into which the plug connector 2 is fit, is formed inside the circumferential wall 9 (FIG. 1), and the opening of the fitting chamber 9*c* forms an insertion port 9*c*1 of the plug connector 2.

The pair of first sidewalls 9*a* each function as a terminal accommodating wall of the movable housing 7 and are formed symmetrically with respect to the center line along the longitudinal direction of the movable housing 7. The first sidewalls 9*a* each have a plurality of terminal fixing sections 9*a*1, which fix movable housing fixing sections 4*d* of the terminals 4 in the plate width direction (direction X) in a press-fitting process, and a plurality of terminal holding grooves 9*a*2, which communicate with the fitting chamber 9*c*, and the terminal fixing sections 9*a*1 and the terminal holding grooves 9*a*2 are formed in line in the terminal arrangement direction X and will be described later.

The terminal holding grooves 9*a*2 as "terminal accommodation sections" each have a pair of sidewalls 9*a*3, which face each other, bottom walls 9*a*4, which link the pair of sidewalls 9*a*3 to each other on opposite sides with respect to the fitting chamber 9*c*, openings 9*a*5, which allow contact sections 4*f* of the terminals 4, which will be described later, to move from the fitting chamber 9*c* to the terminal holding grooves 9*a*2 and vice versa, and slit-shaped substrate-side opening 9*a*6, which face the first substrate P1.

The bottom walls 9*a*4 are each formed of a lower longitudinal surface 9*a*7, which extends in the vertical direction, an inner inclining surface 9*a*8, which inclines in such a way that the separation distance from the fitting chamber 9*c* gradually increases in the height direction Z, and an upper longitudinal surface 9*a*9, which extends from the inner inclining surface 9*a*8 in the height direction Z. The inner inclining surface 9*a*8 is formed so as to incline in the displacement direction of the contact section 4*f*, so that the contact section 4*f* of the corresponding terminal 4, which is displaced toward the bottom wall 9*a*4 when the contact section 4*f* receives contact produced by the pressing plug connector 2, will not come into contact with the bottom wall 9*a*4. The space between the bottom wall 9*a*4, which has the thus configured inner inclining surface 9*a*8, and the fitting chamber 9*c* forms a retraction space 9*a*10, which prevents from abutting against the contact section 4*f*. The outer surface portion of the movable housing 7 that corresponds to the inner inclining surface 9*a*8 of the bottom wall 9*a*4 forms an outer inclining surface 9*a*11, and the technical meaning of the outer inclining surface 9*a*11 will be described later.

The displacement restricting protrusions 9*b*1, which are inserted into the recesses 8*b*1 of the fixed housing 6 described above, are formed on the pair of second sidewalls 9*b*. The displacement restricting protrusions 9*b*1 are formed as columnar protrusions that protrude toward the lateral side of the second sidewalls 9*b*. Fixture insertion grooves 9*b*2 are formed above the displacement restricting protrusions 9*b*1 (FIG. 5). The displacement restricting protrusions 9*b*1 face and can abut against the recesses 8*b*1 in the direction Y and downward direction Z and face and can abut against a lateral piece section 5*c*, which serves as "abutment sections" of the fixtures 5, which will be described later, in the upward direction Z, whereby the abutment of the displacement restricting protrusions 9*b*1 against the portions facing thereto in the directions described above restricts excessive displacement of the movable housing 7.

Insertion Guiding Surface 10

The movable housing 7 has an insertion guiding surface 10. Specifically, the insertion guiding surface 10 is formed on the upper surface of the circumferential wall 9 and the surface of a protruding section 9*e*, which so protrudes from the upper end of an outer circumferential surface 9*d* of the circumferential wall 9 as to form an outward flange shape. The insertion guiding surface 10 in the present embodiment is formed of an inner guiding surface 10*a*, an intermediate guiding surface 10*b*, and an outer guiding surface 10*c*. The insertion guiding surface 10, which is formed of the plurality of surfaces 10*a*, 10*b*, and 10*c*, is formed as a continuous surface extending in the direction that intersects the direction in which the plug connector 2, which is the connection target object, is inserted (direction Z) into the fitting chamber 9*c*. The insertion guiding surface 10, which is formed not only of the inner guiding surface 10*a*, which leads to the fitting chamber 9*c*, but the intermediate guiding surface 10*b* and the outer guiding surface 10*c*, which are located around the outer circumference of the inner guiding surface 10*a* and continuous therewith, allows the insertion of the plug connector 2 to be guided over a wide range around the insertion port 9*c*1, whereby the fitting operation can be readily performed.

The inner guiding surface 10*a*, the intermediate guiding surface 10*b*, and the outer guiding surface 10*c* are so formed that the angles thereof with respect to a line (reference line L (FIG. 6)) perpendicular to the direction in which the plug connector 2 is inserted into the fitting chamber 9*c* (direction Z) differ from one another. In other words, the three guiding surfaces are so formed that the angles thereof with respect to a line (reference line L) parallel to the front surface of the first substrate P1 (mounting surface), on which the socket connector 1 is mounted, differ from one another. The "reference line L" is a horizontal line in the present embodiment.

The inner guiding surface 10*a* is formed on part of the upper surface of the circumferential wall 9. Specifically, the inner guiding surface 10*a* is formed along the edge of the insertion port 9*c*1 of the fitting chamber 9*c*. The inner guiding surface 10*a* has a pair of longitudinal inner guiding surfaces 10*a*1 along the longitudinal direction (direction X) of the socket connector 1 and a pair of lateral inner guiding surfaces 10*a*2 along the lateral direction (direction Y) of the socket connector 1. Since the angle θ1 (FIG. 6) of the inner guiding surface 10*a* with respect to the aforementioned reference line L allows formation of a portion where the inner guiding surface 10*a* so guides the plug connector 2 as to cause it to fall via the insertion port 9*c*1 into the fitting chamber 9*c*, the angle θ1 is greater than the angle of the intermediate guiding surface 10*b* with respect to the reference line L (0 degrees) and the angle θ2 of the outer guiding surface 10*c* with respect to the reference line L. Since the inner guiding surface 10*a* is an acute-angle steep slope, the distance over which the plug connector 2 moves in the directions X and Y is short, whereby the plug connector 2 can smoothly fall into the fitting chamber 9*c*. The inner guiding surface 10*a* is formed as a flat surface and the degree of inclination does not vary compared with a case where the inner guiding surface 10*a* is formed as a curved surface. The plug connector 2 can therefore be smoothly moved into the fitting chamber 9*c* along the constant inclining surface.

The intermediate guiding surface 10*b* is formed on part of the upper surface of the circumferential wall 9. Specifically, the intermediate guiding surface 10*b* is formed as a surface bent and extending from the upper edge of the inner guiding surface 10*a*. The intermediate guiding surface 10*b* has longitudinal intermediate guiding surfaces 10*b*1 along the longitudinal direction of the socket connector 1 and lateral intermediate guiding surfaces 10*b*2 along the lateral direction of the socket connector 1. The intermediate guiding surface 10*b* inclines with respect to the reference line L described above by 0 degrees, which is smaller than the inclination angles of the inner guiding surface 10*a* and the outer guiding surface 10*c* with respect to the reference line L. Since the angle of the intermediate guiding surface 10*b* with respect to the reference line L is 0 degrees, the intermediate guiding surface 10*b* is formed as a non-inclining horizontal surface. Since the intermediate guiding surface 10*b* is a horizontal surface, the plug connector 2 placed on the intermediate guiding surface 10*b* has an attitude that does not incline with respect to the reference line L. The no-inclination attitude of the plug connector 2 and the second substrate P2 on which the plug connector 2 has been mounted is readily grasped by an operator who performs the fitting operation in the form of hand sensation. The operator then moves the second substrate P2 (plug connector 2) having the no-inclination attitude, and when the operator feels that the plug connector 2 rides up on the inclining surface, the operator can feel that the plug connector 2 is being moved toward the outer guiding surface 10*c*, which is opposite the insertion port 9*c*1, in the form of hand sensation, whereby the operator can recognize that the moving direction should be corrected to the opposite direction. On the other hand, the operator moves the second substrate P2 having the no-inclination attitude, and when the plug connector 2 falls in an oblique direction or fall in the no-inclination attitude, the operator can recognize that the plug connector 2 is being moved toward the inner guiding surface 10*a* in the form of hand sensation and that the plug connector 2 can be inserted into the fitting chamber 9*c*.

The outer guiding surface 10*c* is formed on part of the upper surface of the circumferential wall 9 and the upper surface of the protruding section 9*e*, which protrudes from the circumferential wall 9. Specifically, the outer guiding surface 10*c* has longitudinal outer guiding surfaces 10*c*1 along the longitudinal direction of the socket connector 1 and lateral outer guiding surfaces 10*c*2 along the lateral direction of the socket connector 1. The lateral outer guiding surfaces 10*c*2 are formed on the upper surface of the protruding section 9*e*, and the longitudinal outer guiding surfaces 10*c*1 are formed on the upper surface of the circumferential wall 9 inside the protruding section 9*e*. The longitudinal outer guiding surfaces 10*c*1 and the lateral outer guiding surfaces 10*c*2 are each formed as a surface bent and extending from the outer edge of the intermediate guiding surface 10*b*. The angle θ2 (FIG. 6) of the outer guiding inclining surface 10*c* with respect to the reference line L described above is greater than the angle of the intermediate guiding surface 10*b* with respect to the reference line L (0 degrees) but smaller than the angle θ1 of the inner guiding surface 10*a* with respect to the reference line L. That is, the outer guiding surface 10*c* is formed as an inclining surface that is not as steep as the inner guiding surface 10*a*. The plug connector 2 placed on the outer guiding surface 10*c* can therefore be moved along the outer guiding surface 10*c* with the plug connector 2 having an inclining attitude and guided to the adjacent non-inclining intermediate guiding surface 10*b*.

The inner guiding surface 10*a*, the intermediate guiding surface 10*b*, and the outer guiding surface 10*c* are so configured that the angles thereof with respect to the reference line L differ from one another, as described above. Placing the plug connector 2 in the socket connector 1 (movable housing 7) therefore allows the operator to grasp a rough position of the plug connector 2 in the form of a hand sensation by the attitude of the second substrate P2 on which the plug connector 2 has been mounted. The aspect in which the plug connector 2 is in contact with the guiding inclining surface 10 includes a variety of cases, for example, a case where the plug connector 2 abuts only against the outer guiding surface 10*c*, a case where the plug connector 2 abuts against the outer guiding surface 10*c* and the intermediate guiding surface 10*b*, a case where the plug connector 2 abuts only against the intermediate guiding surface 10*b*, and a case where the plug connector 2 abuts only against the inner guiding surface 10*a*, and the attitude of the plug connector 2 varies across the cases. Therefore, the plug connector 2 has the horizontal attitude described above on the intermediate guiding surface 10*b* by causing the second substrate P2 to move from the position where the plug connector 2 has first come into contact with the guiding inclining surface 10 in a variety of directions (direction X, direction Y) along the reference line L, then the second substrate P2 is caused to move from this state in such a way that the plug connector 2 falls along the inner guiding surface 10*a*, the plug connector 2 fits correctly into the socket connector 1 with the aid of the hand sensation, even though the operator cannot directly see the socket connector 1 or the plug connector 2.

The thus configured guiding inclining surface 10 is formed in a frame-like shape along the shape of the upper surface of the movable housing 7. Specifically, the guiding inclining surface 10 is formed in a rectangular-frame-like shape in the present embodiment. Therefore, even when the plug connector 2 is positionally shifted from the center of the insertion port 9*c*1 in any radial direction (directions X and Y), the plug connector 2 is allowed to abut against the guiding inclining surface 10, whereby the plug connector 2 can be reliably guided to the insertion port 9*c*1.

Terminals 4

The plurality of terminals 4 are all formed in the same shape and are each formed as a bent electrically conductive metal piece. The terminals 4 each have a substrate connection section 4*a*, which is soldered to the first substrate P1, a fixed housing fixing section 4*b*, which is press-fitted and fixed to the corresponding terminal fixing section 8*a*1 of the fixed housing 6, the spring section 4*c*, which extends in an inverted U-letter shape, the movable housing fixing section 4*d*, which is press-fit and fixed to the corresponding terminal fixing section 9*a*1 of the movable housing 7 in the plate width direction (direction X), an elastic arm 4*e*, which extends in a U-letter shape, and the contact section 4*f*, which bends from the upper end of the elastic arm 4*e* convexly toward the fitting chamber 9*c*.

The spring section 4*c* is formed as a spring that supports the movable housing 7 in such a way that the movable housing 7 is displaceable relative to the fixed housing 6 in the three-dimensional directions, which are the combination of the width direction (direction X), the depth direction (direction Y), and the height direction (direction Z). The spring section 4*c* has an outer extending section 4*c*1, which leads to the fixed housing fixing section 4*b*, a bent section 4*c*2, and an inner inclining piece section 4*c*3.

The outer extending section 4*c*1 is so located as to face the contact clearance section 8*a*3, which is so formed on the inner inclining surface 8*a*2 of the first sidewall 8*a* of the fixed housing 6, and is configured not to come into contact with the inner inclining surface 8*a*2 even when the movable housing 7 is elastically deformed outward in the direction Y. Half of the curved section of the bent section 4*c*2 that is on the side of the movable housing 7 is covered and protected with the protruding section 9*e* of the movable housing 7 so that no foreign matter (such as electrically conducting substances and dust) externally comes into contact with the half of the bent section 4*c*2. The inner inclining piece section 4*c*3 obliquely extends along the corresponding outer inclining surface 9*a*11 of the movable housing 7 with a fixed gap therebetween. Therefore, even when the movable housing 7 is elastically deformed outside in the direction Y, the inner inclining piece section 4*c*3 does not come into contact with the outer inclining surface 9*a*11 or does not hinder natural elastic deformation of the spring section 4*c*.

The elastic arm 4*e* has a lower bent section 4*e*1, which has a U-letter-like shape, and an extending section 4*e*2, which extends upward from the lower bent section 4*e*1. The extending section 4*e*2 is disposed in the corresponding terminal holding groove 9*a*2 of the movable housing 7. The upper side of the extending section 4*e*2 is adjacent to the corresponding retraction space 9*a*10. Therefore, even when the contact section 4*f* is pressed by and comes into contact with the plug connector 2 and enters the terminal holding groove 9*a*2, the extending section 4*e*2 is merely displaced toward the retraction space 9*a*10 but does not come into contact with the bottom surface of the corresponding bottom wall 9*a*4. The contact section 4*f* can therefore press and come into contact with the plug connector 2 at contact pressure based on the spring structure of the elastic arm 4*e* and the contact section 4*f*.

Fixture 5

The fixtures 5 are provided on the pair of second sidewalls 8*b* of the fixed housing 6, respectively. The fixtures 5 each have a substrate fixing section 5*a*, a press fitting section 5*b*, which is press-fitted and fixed to the fixing section 8*b*2 of the corresponding second sidewall 8*b*, and a lateral piece section 5*c*, which extends along the length direction (direction Y) of the second sidewall 8*b*.

Figure 10:
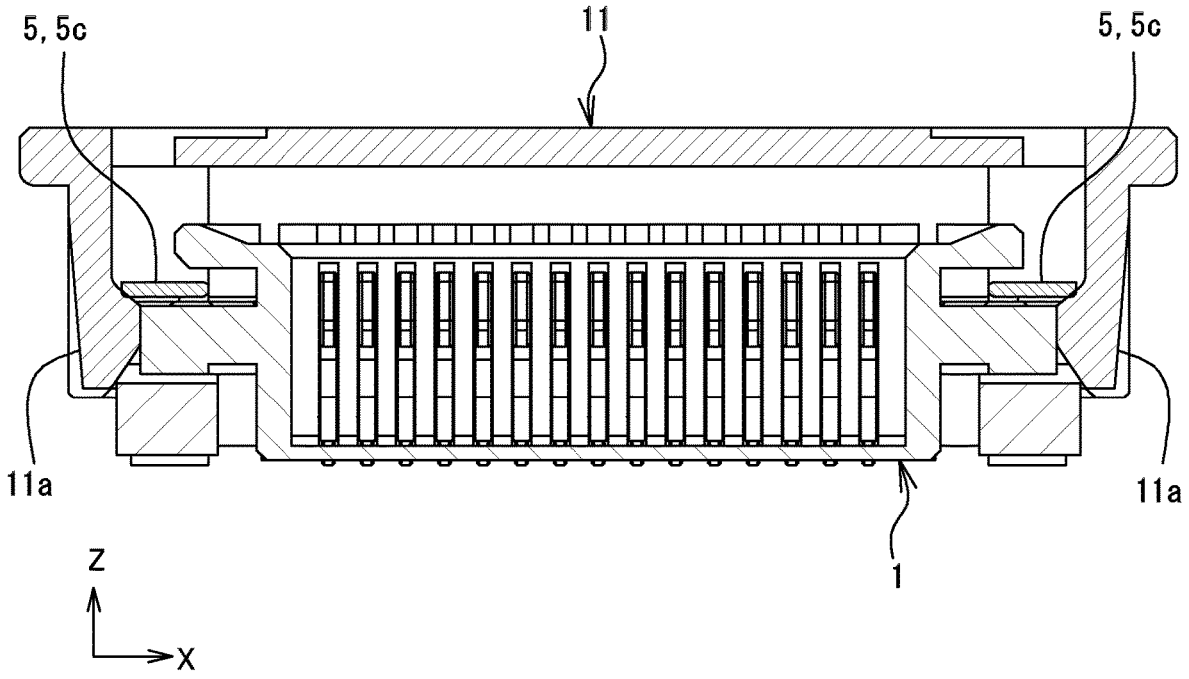
FIG. 10 is a cross-sectional view corresponding to FIG. 5 and showing the state in which a protective cap is attached to the socket connector shown in FIG. 1.

The lateral piece section 5*c* is inserted via a gap into the corresponding fixture insertion groove 9*b*2 of the movable housing 7. Locking pieces 11*a* of a protective cap 11 lock to the lateral piece sections 5*c*, as shown in FIG. 10. That is, the lateral piece sections 5*c* function as an "attachment section" of the protective cap 11. The fixed housing 6 therefore does not need to have "the attachment section", and the fixtures 5, which are each a metal rigid element, allows the protective cap 11 to be reliably attached and is not broken by operation of attaching and detaching the protective cap 11. By providing the socket connector 1 with the protective cap 11, the socket connector can prevent foreign matter from entering and adhering to the fitting chamber 9*c* or the terminals 4 from being damaged during transportation, mounting, and other types of handling of the socket connector 1. Further, the protective cap 11 can be used as a sucked portion when the socket connector 1 is transported by an automatic machine during mounting on the first substrate P1.

The lateral piece sections 5*c* are so located as to face the displacement restricting protrusions 9*b*1 of the movable housing 7 and function as an "abutment section" that prevents upward excessive displacement of the movable housing 7 in the height direction (direction Z). The fixed housing 6 therefore needs to be provided with no "abutment section", and the fixtures 5 can be effectively used to restrict the displacement of the movable housing 7.

Fitting Connected Between Socket Connector 1 and Plug Connector 2

The fitting connection between the socket connector 1 having the connector structure described above and the plug connector 2 will next be described.

Figure 7:
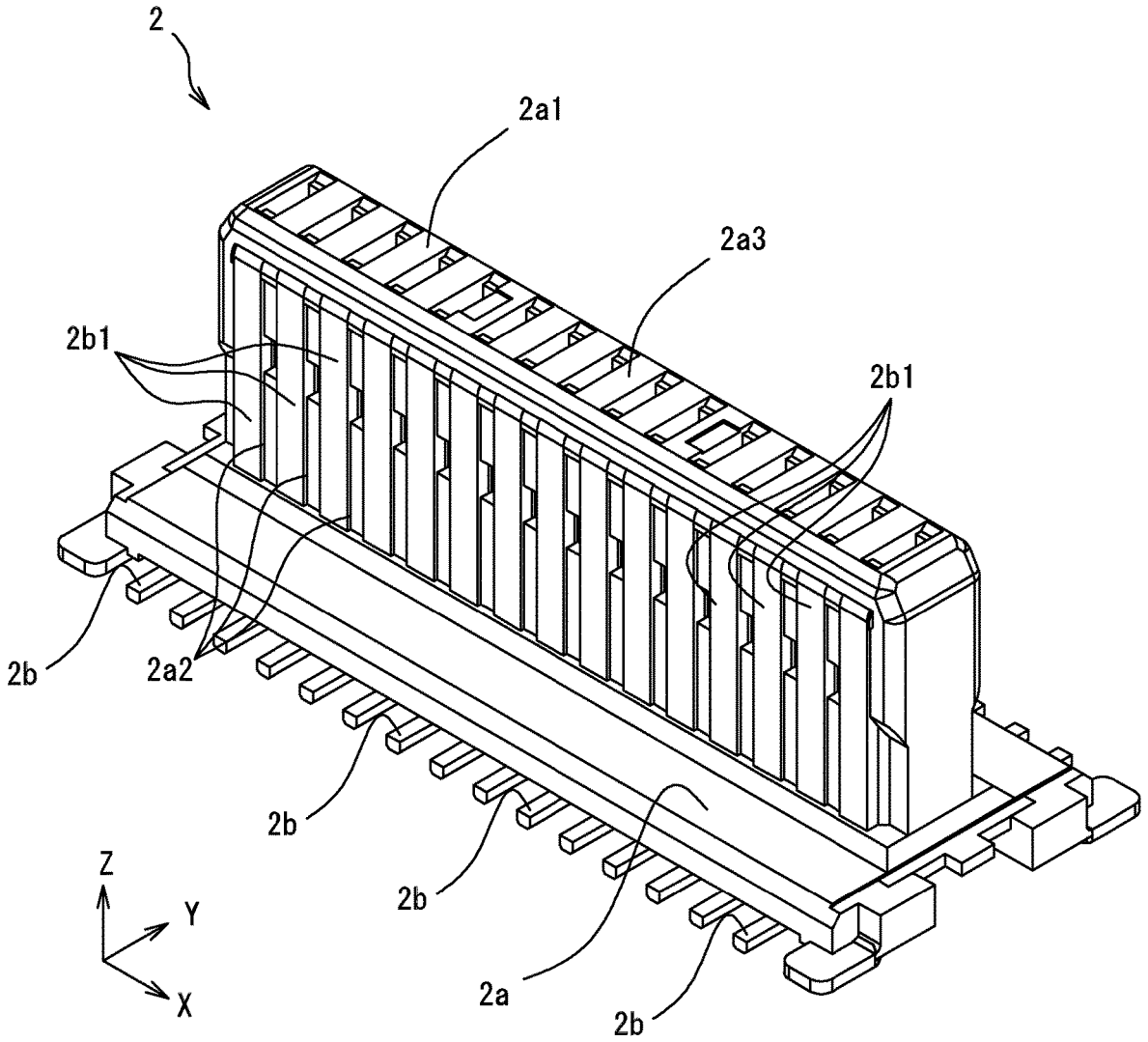
FIG. 7 is an exterior perspective view including the front surface, the right side surface, and the plan surface of a plug connector fit into the socket connector shown in FIG. 1.

The connector structure of the plug connector 2 will first be briefly described. The plug connector 2 is mounted on the second substrate P2 and includes a housing 2*a* and a plurality of terminals 2*b*, as shown in FIG. 7. The housing 2*a* includes a plate-shaped fitting connection section 2*a*1, which is inserted into the fitting chamber 9*c*, and terminal holding grooves 2*a*2, which extend in the height direction (direction Z) of the housing 2*a*, are formed in parallel to each other along the width direction (direction Y) in a surface on one side and a surface on the other side of the fitting connection section 2*a*1 that extend in the longitudinal direction Y). Contact sections 2*b*1 of the terminals 2*b* are disposed in the terminal holding grooves 2*a*2.

Figure 8:
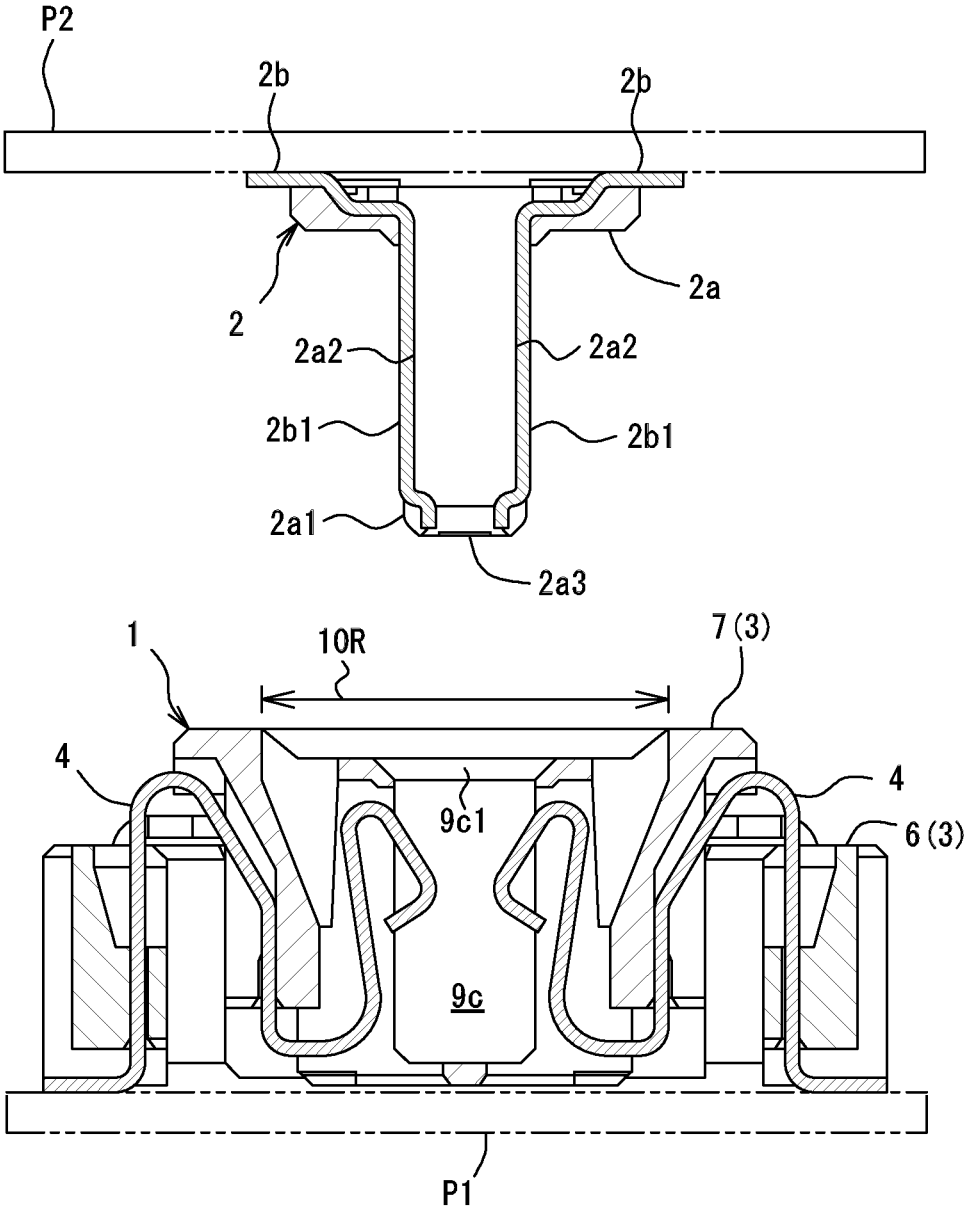
FIG. 8 is a cross-sectional view showing the process of fitting the plug connector shown in FIG. 7 into the socket connector shown in FIG. 1.

To fit and connect the thus configured plug connector 2 to the socket connector 1, the second substrate P2 on which the plug connector 2 has been mounted is turned upside down so that the plug connector 2 faces the socket connector 1 as shown in FIG. 8. The second substrate P2 is then caused to approach the first substrate P1 to cause the plug connector 2 to come into contact with the socket connector 1. At this point, if a front-end surface 2*a*3 of the housing 2*a* of the plug connector 2 is positionally shifted from the center of a guiding area 10R of the insertion guiding surface 10 including the insertion port 9*c*1 but in contact with the insertion guiding surface 10, the insertion guiding surface 10 allows the plug connector 2 to be guided to the insertion port 9*c*. It is, however, noted that even though the front-end surface 2*a*3 comes off the insertion guiding surface 10, the second substrate P2 only can be caused to move in the directions X and Y and fall within the guiding area 10R of the guiding inclining surface 10.

The most ideal position where the front-end surface 2*a*3 comes into contact with the movable housing 7 is a position inside the inner guiding surface 10*a* in the directions X and Y, that is, a position inside the insertion port 9*c*1. However, the sizes of the socket connector 1 and the plug connector 2 for substrate-to-substrate connection tend to decrease, and it is very difficult for the operator to precisely align the socket connector 1 and the plug connector 2 with each other in the state in which they are sandwiched between first substrate P1 and the second substrate P2 and are therefore not visible from outside. Further, the front-end surface 2*a*3 not only is positionally shifted in the in-plane direction of the directions X and Y but rotates around the axes X, Y, and Z, that is, the attitude of the plug connector 2 inclines with respect to the axes.

Figure 9:
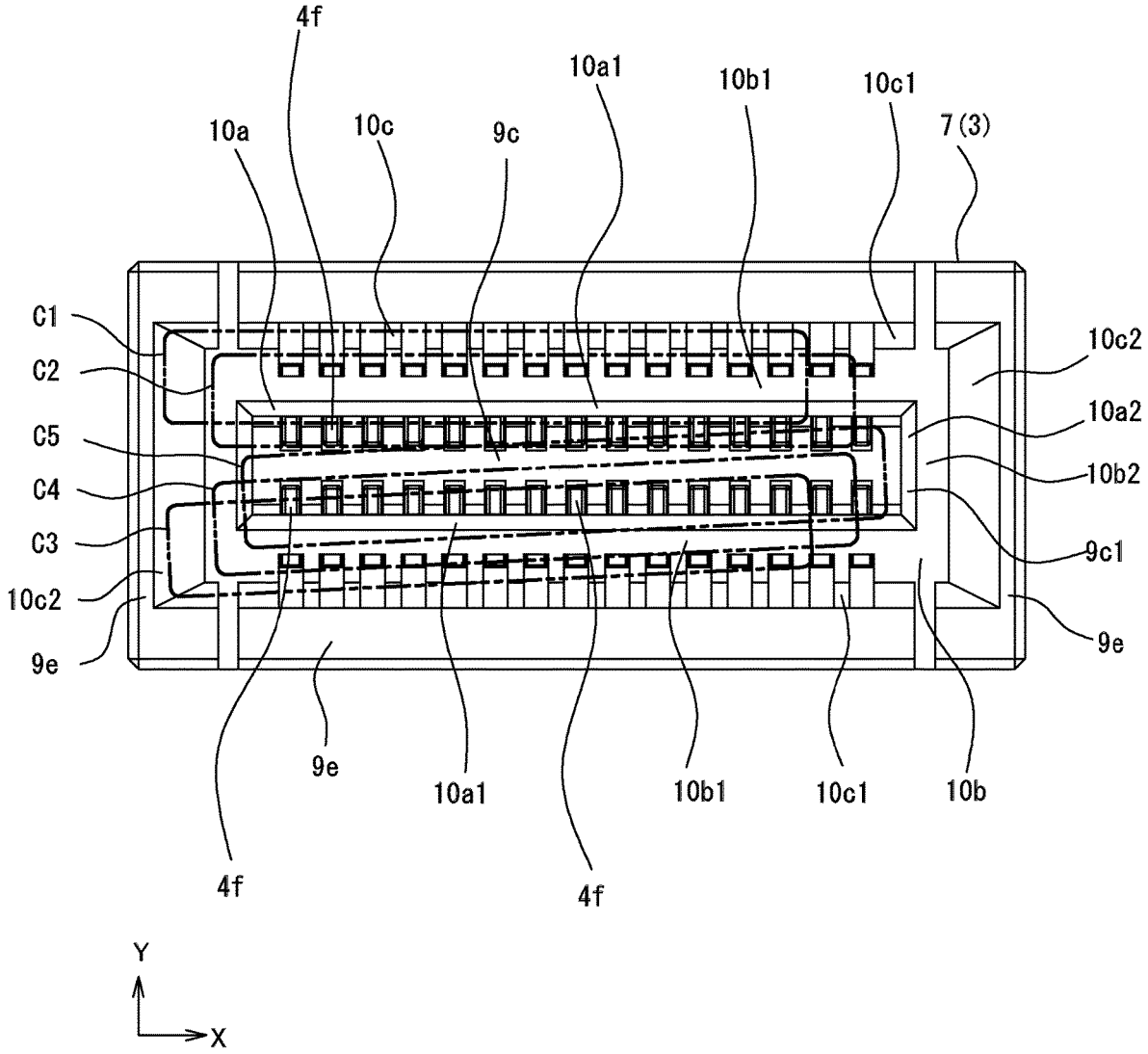
FIG. 9 is a descriptive diagram showing an effect of an insertion guiding surface of the socket connector shown in FIG. 1.

FIG. 9 shows the front-end surface 2*a*3 being in contact with the upper surface of the movable housing 7 and drawn by two-dot chain lines. For example, in a case where the front-end surface 2*a*3 comes into contact with the insertion guiding surface 10 in a contact position C1, the front-end surface 2*a*3 sequentially comes into contact with the outer guiding surface 10*c* and the intermediate guiding surface 10*b*. This holds true irrespective of the attitude of the front-end surface 2*a*3 at the time of contact, the horizontal attitude or an inclining attitude. Because the attitude of the front-end surface 2*a*3 is corrected when the front-end surface 2*a*3 comes into contact with the outer guiding surface 10*c* and the intermediate guiding surface 10*b*. The front-end surface 2*a*3 then slides along the inclining outer guiding surface 10*c* and can be guided to a contact position C2, where the entire front-end surface 2*a*3 is in contact with the intermediate guiding surface 10*b*. Once the front-end surface 2*a*3 comes into contact with the intermediate guiding surface 10*b*, which is a flat horizontal surface, the plug connector 2 and the second substrate P2 are so corrected as to have the non-inclining attitude, whereby the operator can recognize the change in the attitude in the form of hand sensation. Thereafter, when the second substrate P2 is moved in the directions X and Y, the area where the front-end surface 2*a*3 is in contact with the intermediate guiding surface 10*b* decreases, whereas the area where the front-end surface 2*a*3 covers the insertion port 9*c*1 increases, resulting in disruption of a balance of the front-end surface 2*a*3 supported by the intermediate guiding surface 10*b*. Part or the entirety of the front-end surface 2*a*3 therefore falls through the inner guiding surface 10*a* into the insertion port 9*c*1, whereby the entire fitting connection section 2*a* can be inserted into the fitting chamber 9*c*.

Further, for example, in a case where the front-end surface 2*a*3 rotates around the axis Z and comes into contact with the insertion guiding surface 10 in a contact position C3 shown in FIG. 9, the plug connector 2 is guided in the same manner as in the case where the front-end surface 2*a*3 comes into contact with the insertion guiding surface 10 in the contact position C1. That is, once the front-end surface 2*a*3 comes into contact with the outer guiding surface 10*c* and the intermediate guiding surface 10*b*, the front-end surface 2*a*3 slides along the outer guiding surface 10*c* and comes into contact with the intermediate guiding surface 10*b*, as indicated by a contact position C4, so that the plug connector 2 and the second substrate P2 are so corrected as to have non-inclining attitude. In this state, the second substrate P2 is moved in the directions X and Y to a contact position C5, resulting in disruption in a balance of the front-end surface 2*a*3 supported by the intermediate guiding surface 10*b*. The front-end surface 2*a*3 therefore falls through the inner guiding surface 10*a* into the insertion port 9*c*1, whereby the entire fitting connection section 2*a* can be inserted into the fitting chamber 9*c*.

Advantageous Effects of Socket Connector 1

According to the socket connector 1 described above, even in a case where the position where the plug connector 2 is inserted into the insertion port 9*c*1 is shifted, the insertion guiding surface 10 can eliminate the positional shift and guide the plug connector 2 to the insertion port 9*c*1, whereby the fitting connection section 2*a*1 of the plug connector 2 can be correctly inserted into the fitting chamber 9*c* via the insertion port 9*c*1. Since the fitting operation can thus be readily performed, the sizes of the socket connector 1 and the plug connector 2 can be reduced. Further, the socket connector 1 can provide the following advantageous effects as well as already described.

Since the insertion guiding surface 10 of the socket connector 1 is so configured that the angles of the inner guiding surface 10*a*, the intermediate guiding surface 10*b*, and the outer guiding surface 10*c* with respect to the reference line L differ from one another, the attitude of the plug connector 2 is allowed to vary in accordance with the position where the front-end surface 2*a*3 comes into contact with the insertion guiding surface 10.

Since the angle θ2 of the outer guiding surface 10*c* with respect to the reference line L is greater than the angle of the intermediate guiding surface 10*b*, which is a horizontal flat surface, with respect to the reference line L (0 degrees), the plug connector 2 can be readily guided to an inner position closer to the insertion port 9*c*1 rather than the outer guiding surface 10*c*. Further, since the angle θ1 of the inner guiding surface 10*a* with respect to the reference line L is greater than the angle of the intermediate guiding surface 10*b* with respect to the reference line L (0 degrees), the plug connector 2 can be smoothly guided from the intermediate guiding surface 10*b* to the inner guiding surface 10*a*, which is directly connected to the insertion port 9*c*1.

Since the intermediate guiding surface 10*b* is a flat surface parallel to the first substrate P1, the distance over which the plug connector 2 is movable in the horizontal direction can be increased as compared with a case where the intermediate guiding surface 10*b* is an inclining surface, whereby the acceptable range of the positional shift (guiding region) of the plug connector 2 on the intermediate guiding surface 10*b* can be widened. Further, in the case where the intermediate guiding surface 10*b* is an inclining surface, there is a height difference between the inner edge and the outer edge of the intermediate guiding surface 10*b*, resulting in an increase in the size of the movable housing 7 in the height direction (direction Z). In the embodiment described above, however, an increase in the size of the movable housing 7 can be suppressed because the intermediate guiding surface 10*b* is a horizontal surface.

In the embodiment described above, since the inclination angle θ2 of the outer guiding surface 10*c* is smaller than the inclination angle θ1 of the inner guiding surface 10*a*, an increase in the size of the movable housing 7 in the height direction (direction Z) due to the outer guiding surface 10*c* can be avoided while a sufficient distance over which the plug connector 2 is moved from the outer edge to the inner edge of the outer guiding surface 10*c* is ensured. Further, since the inclination angle θ2 of the outer guiding surface 10*c* is smaller than the inclination angle θ1 of the inner guiding surface 10*a*, the plug connector 2 is roughly guided toward the insertion port 9*c*1 side by causing the plug connector 2 to move on the outer guiding surface 10*c* having a shallow inclination, and then it is possible to insert the plug connector 2 so as to swiftly incorporate it from the insertion port 9*c*1 into the fitting chamber 9*c* through the inner guiding surface 10*a*, which has an inclination angle larger than that of the outer guiding surface 10*c*.

In the embodiment described above, since the lateral outer guiding surfaces 10*c*2 of the outer guiding surface 10*c* are provided on the upper surface of the protruding section 9*e*, the outer guiding surface 10*c* can be extended in the direction away from the insertion port 9*c*1 without an increase in the thickness of the circumferential wall 9, whereby the acceptable range of the positional shift of the plug connector 2 can be widened.

In the embodiment described above, since the intermediate guiding surface 10*b* and the longitudinal outer guiding surfaces 10*c*1 are provided as part of the upper surface of the circumferential wall 9, the upper surface of the circumferential wall 9 can be effectively used, whereby the intermediate guiding surface 10*b* can be provided without an increase in the size of the movable housing 7, such as an increase in the thickness of the circumferential wall 9.

Variations

Variations of the socket connector 1 according to the embodiment described above are conceivable and one of variations is described below.

In the embodiment described above, the longitudinal outer guiding surfaces 10*c*1 are provided on part of the upper surface of the circumferential wall 9 by way of example and may instead be formed as part of the upper surface of the protruding section 9*e* or on the range from the upper surface of the protruding section 9*e* to the upper surface of the circumferential wall 9. Further, in the embodiment described above, the lateral outer guiding surfaces 10*c*2 are provided as part of the upper surface of the protruding section 9*e* by way of example and may instead be formed as part of both the upper surface of the protruding section 9*e* and the upper surface of the circumferential wall 9. Moreover, in the embodiment described above, the longitudinal outer guiding surfaces 10*c*1 are so formed as to be longer in the inclination direction than the lateral outer guiding surfaces 10*c*2. Instead, the length of the longitudinal outer guiding surfaces 10*c*1 may be equal to the length of the lateral outer guiding surfaces 10*c*2, or the lateral outer guiding surfaces 10*c*2 may conversely longer than the longitudinal outer guiding surfaces 10*c*1.

In the embodiment described above, the intermediate guiding surface 10*b* is provided on the upper surface of the circumferential wall 9 by way of example and may instead be provided on the range from the upper surface of the circumferential wall 9 to the upper surface of the protruding section 9*e*.

In the embodiment described above, the inclination angle θ2 of the outer guiding surface 10*c* is made smaller than the inclination angle θ1 of the inner guiding surface 10*a* by way of example, but instead the inclination angle of the outer guiding surface 10*c* may be made greater than, or the inclination angles may be made equal. Further, in the embodiment described above, the intermediate guiding surface 10*b* is a non-inclining surface by way of example and may instead be formed as an inclining surface that inclines obliquely downward toward the inner guiding surface 10*a*.

In the embodiment described above, the inner guiding surface 10*a*, the intermediate guiding surface 10*b*, and the outer guiding surface 10*c* are each formed as a flat surface by way of example and may instead be each formed as a curved surface.

In the embodiment described above, the socket connector 1 is a floating connector by way of example. Instead, a socket connector having no floating function may be configured to have the same configuration as that of the insertion guiding surface 10 of the movable housing 7.

What is claimed is:

1. An electrical connector comprising:

a housing having an insertion port into which a connection target object is inserted in a direction toward a surface of a substrate as an insertion direction and a fitting chamber into which the connection target object is inserted via the insertion port; and terminals that are connected to the connection target object in the fitting chamber so that the terminals are electrically continuous with the connection target object, wherein the housing has an insertion guiding surface that guides the insertion of the connection target object via the insertion port, the insertion guiding surface has an inner guiding surface that extends from an edge of the insertion port toward an interior of the fitting chamber, an intermediate guiding surface provided in a region outside the inner guiding surface, and an outer guiding surface provided in a region outside the intermediate guiding surface, and the outer guiding surface, the intermediate guiding, and the inner guiding surface are located along the insertion direction of the connection target object in this order, and the inner guiding surface and the outer guiding surface are at different angles with respect to the insertion direction and a line perpendicular to the insertion direction into the fitting chamber.

2. The electrical connector according to claim 1, wherein an angle between the intermediate guiding surface and the line is smaller than an angle between the inner guiding surface and the line and an angle between the outer guiding surface and the line.

3. The electrical connector according to claim 1, wherein the intermediate guiding surface is a flat surface parallel to the substrate.

4. The electrical connector according to claim 1, wherein the outer guiding surface and the inner guiding surface are formed as inclining surfaces that have a different angle respectively from the line, and the angle between the outer guiding surface and the line is smaller than the angle between the inner guiding surface and the line.

5. The electrical connector according to claim 1, wherein the housing has a circumferential wall and a protruding section that protrudes outward from the circumferential wall, and the outer guiding surface is provided on an upper surface of the protruding section.

6. The electrical connector according to claim 5, wherein the intermediate guiding surface is provided on an upper surface of the circumferential wall.

7. The electrical connector according to claim 1, further comprising a fixed housing fixed to the substrate, wherein the housing is a movable housing movable relative to the fixed housing, and the terminals each have a fixing section fixed to the fixed housing, a fixing section fixed to the movable housing, and a spring section that supports the movable housing in such a way that the movable housing is movable relative to the fixed housing.

8. The electrical connector according to claim 7, wherein the spring sections are located between the movable housing and the fixed housing, and the protruding section is so shaped as to cover an upper side of the spring sections.

* * * * *